United States Patent [19]

Molinari

[11] Patent Number: 4,726,215

[45] Date of Patent: Feb. 23, 1988

[54] ADJUSTABLE DIAMETER STAMP

[75] Inventor: Paul J. Molinari, Manchester, Conn.

[73] Assignee: Western Pacific Industries Inc., New York, N.Y.

[21] Appl. No.: 879,439

[22] Filed: Jun. 27, 1986

[51] Int. Cl.[4] ..... B21J 13/02

[52] U.S. Cl. ..... 72/478; 72/413; 101/28

[58] Field of Search ..... 72/413, 478, 465; 101/28, 29

[56] References Cited

U.S. PATENT DOCUMENTS

| | | | |
|---|---|---|---|
| 481,087 | 8/1892 | Wilson, Sr. | 72/478 |
| 1,519,005 | 12/1924 | Pannier, Jr. | 101/28 |
| 2,627,803 | 2/1953 | Pannier | 101/28 |
| 2,906,150 | 9/1959 | Stewart | 72/478 |
| 3,187,549 | 6/1965 | Guy | 72/478 |

FOREIGN PATENT DOCUMENTS

| | | |
|---|---|---|
| 576834 | 6/1976 | Switzerland . |
| 1031585 | 7/1983 | U.S.S.R. . |

*Primary Examiner*—Robert L. Spruill
*Assistant Examiner*—David B. Jones
*Attorney, Agent, or Firm*—Hayes & Reinsmith

[57] ABSTRACT

A method and apparatus is provided for stamping or printing identification indicia on a circular segment such as the flat portion of the head of a cap screw, bearing race, or stud end. The adjustable diameter stamp uses a plurality of segments which, when fitted together, form a cylinder or other polygonal shape which is held securely in a matching collet during the stamping operation. Variable diameter stamping is accomplished by using different sized stamping segments. Also, shims may be used to provide marking diameter adjustment. The preferred embodiment uses four wedge-shaped stamping segments.

3 Claims, 6 Drawing Figures

ADJUSTABLE DIAMETER STAMP

BACKGROUND OF THE INVENTION

1. Field of the Invention

This invention relates generally to methods and apparatus for stamping or marking identification indicia onto objects. Often it is required to place an identification mark on the head portion of cap screws, bearing races and stud faces of various sizes.

2. Prior Art

Presently stamps or marking devices exist for applying identifying indicia onto objects. Typically the marking device is of a fixed dimension. When the object to be marked is circular or any other polygonal shape, a marking device would be made for the particular size and object. Smaller objects or objects with variations in dimensional accuracy or configuration, could not be marked with the same marking device since the diameter of the stamp or marking device would be fixed and not allow for variations.

SUMMARY OF THE INVENTION

It is the object of this invention to provide an adjustable diameter stamp so that objects of varying sizes may be marked or stamped with the same collet and segments. By varying the size of stamp or marker segments used in a collet holder, an adjustable diameter stamp is provided. The use of one or more shims with the segments provides an alternative method and means for altering the diameter of the stamp. By forming a family of groups of stamping segments, each group of a different size, stamping identification indicia on different sized pieces may be accomplished. The aforementioned shim stock acts to fine tune the family group to a particular part to be marked.

DETAILED DESCRIPTION OF THE INVENTION

Figure 4:
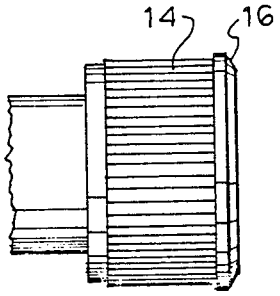
FIGS. 3 and 4 are front and side views of a cap screw showing the marking band to be marked by the invention.
Figure 3:
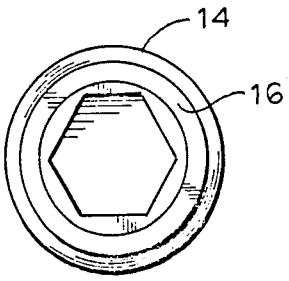
Figure 1:
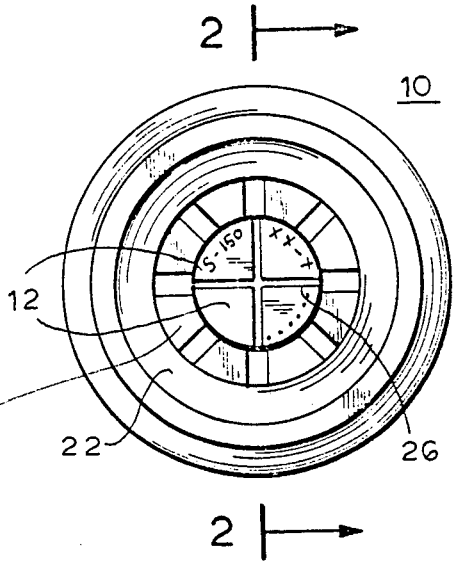
FIG. 1 is a head-on view of the marking portion of the stamp of this invention.
Figure 2:
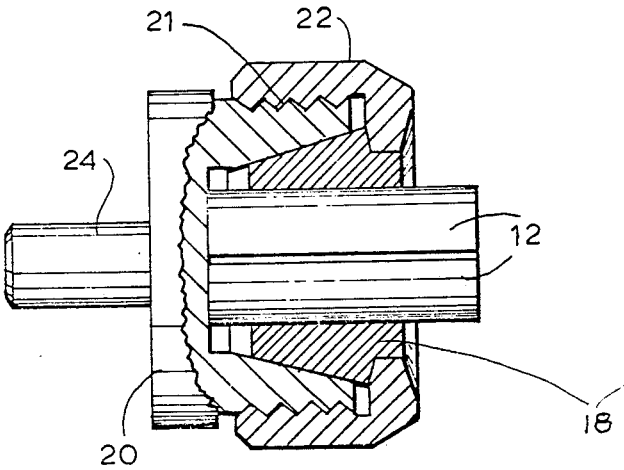
FIG. 2 is a partial cross-sectional view along lines 2—2 of FIG. 1.

In the preferred embodiment of the invention, shown in FIGS. 1 and 2, an adjustable diameter stamp 10 uses four wedge-shaped, quarter circle segments 12 arranged in abuttment to form a cylindrical stamp. Each of the four segments 12 may have a stamp or marking indicia 13 which permits the transfer of identification information to an object to be marked, such as a cap screw 14, shown in FIGS. 3 and 4. The information may be in the form of numbers or marks, possibly in code, which may identify the type, size, color or other characteristics.

The cap screw 14, to be marked or stamped, includes a marking band 16 for receiving the indicia to be marked or stamped. This band varies in diameter and surface area with every manufacturing source.

Referring now to FIGS. 1 and 2 the adjustable diameter stamp 10 comprises the marking segments 12 arranged within a collet 18, which is in turn seated in the collet holder 20 which has external threads 21. The threaded nut 22 aligns the segments 12, collet 18, and collet holder 20 so that as the collet holder 20 is threadably tightened into the nut 22 the rubber portion of collet 18 is distorted so as to secure the segments 12 against movement. The collet holder 20 has a shaft or shank 24 for mounting in a press or other mechanical device suitable for stamping and is not limited to the configuration shown. The arrangement of 18, 20 and 22 may be identified as a holding device. When placed in a press or other mechanical device it may be moved relative to the cap screw 14 so as to permit the markings 13 on the segments 12 to contact the marking band 16 of the cap screw 14 to impart the identification indicia to the marking band 16.

By varying the size of the segments 12 the identification information may be made to come into alignment with different sizes of marking bands 16.

In a still further method of accommodating different diameter cap screws, shims 26 may be used to alter the effective diameter of the cylinder resulting from abutting the segments 12. If the marking diameter is too small, the nut 22 is loosened and shim stock 26 is placed between the segments 12 and the nut 22 retightened. This allows a variety of marking diameters and a full range of supplier parts to be marked by the same tools.

Figure 6:
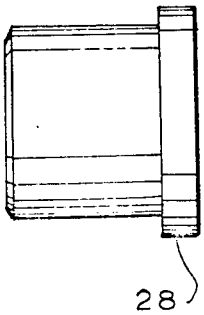
FIG. 6 PRIOR ART
FIGS. 5 and 6 show the front and side views of a prior art stamp.
Figure 5:
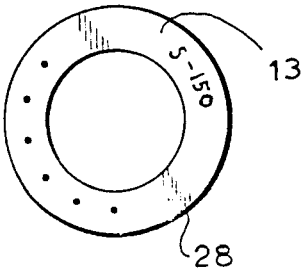
FIG. 5 PRIOR ART

FIGS. 5 and 6 illustrate a prior art device in which a one piece marker having marking indices 13 may be used. In such an arrangement the diameter of the stamp is not adjustable and a separate marker must be made for each size cap screw to be marked.

It should be understood that the object to be marked could be square or any other shape and that the invention described herein is intended to provide a method and apparatus for a variable-dimension stamp. Also, the number of stamp segments may be more or less than the four shown.

As may be seen from the above description the adjustable dimension system or method devised comprises marking indicia bearing stamping segments of various sizes, mounting selected segments in a collet, collet holder and nut to temporarily fix the segments relative to each other, mounting the collet holder in a press or other mechanical device and bringing the indicia-bearing stamping segments into contact with the object to be stamped or marked.

Minor variations of this invention may be envisioned without departing from the scope of the invention as claimed.

I claim:

1. An adjustable dimension stamp comprising a plurality of stamp segments, a flexible collet for retaining the stamp segments in a predetermined position within the collet, a holder for receiving at least a portion of the segment-retaining collet, and a nut mounted on the holder in threaded engagement therewith, the nut and the holder being adjustable relative to one another for securing the collet and the stamp segments in preselected fixed relation to one another.

2. An adjustable diameter marking stamp comprising four wedge-shaped stamp segments at least one of which bears identification indicia and which, when placed together form a cylindrical stamp, flexible collet means for receiving the wedge-shaped stamp segments, threaded collet holder means for receiving the said flexible collet, and threaded nut means for threadably engaging the threaded collet whereby, upon tightening the flexible collet distorts to engage the segments so the stamp segments are fixed relative to each other and to the collet, holder and nut.

3. The apparatus according to claim 2 further comprising shim means between at least two of the stamp segments whereby the relative dimensions of the stamping indicia is altered.

* * * * *